US009448496B2

(12) United States Patent
Azuma et al.

(10) Patent No.: US 9,448,496 B2
(45) Date of Patent: Sep. 20, 2016

(54) ELECTROPHOTOGRAPHIC PHOTOSENSITIVE MEMBER

(71) Applicant: KYOCERA Document Solutions Inc., Osaka-shi (JP)

(72) Inventors: Jun Azuma, Osaka (JP); Keiji Maruo, Osaka (JP); Kensuke Okawa, Osaka (JP); Akihiko Ogata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/719,911

(22) Filed: May 22, 2015

(65) Prior Publication Data

US 2015/0338754 A1 Nov. 26, 2015

(30) Foreign Application Priority Data

May 23, 2014 (JP) ..... 2014-106721

(51) Int. Cl.
*G03G 5/047* (2006.01)
*G03G 5/06* (2006.01)

(52) U.S. Cl.
CPC ..... *G03G 5/047* (2013.01); *G03G 5/0614* (2013.01); *G03G 5/0672* (2013.01); *G03G 5/0696* (2013.01)

(58) Field of Classification Search
CPC ..... G03G 5/0614; G03G 5/0696
See application file for complete search history.

(56) References Cited

U.S. PATENT DOCUMENTS

2007/0281227 A1* 12/2007 Maruo ..... G03G 5/047 430/58.05
2013/0236821 A1* 9/2013 Ide ..... G03G 15/75 430/56

FOREIGN PATENT DOCUMENTS

JP S60-233655 A 11/1985
JP H06-118665 A 4/1994

* cited by examiner

*Primary Examiner* — Peter Vajda
(74) *Attorney, Agent, or Firm* — Studebaker & Brackett PC

(57) ABSTRACT

An electrophotographic photosensitive member includes a conductive substrate and a photosensitive layer. The photosensitive layer includes a charge generating layer and a charge transport layer located on the charge generating layer. The charge transport layer contains a pigment that is absorptive with respect to a wavelength of exposed light. The pigment is a metal phthalocyanine pigment represented by General Formula (I) or a metal-free phthalocyanine pigment represented by General Formula (II), where X represents a sulfur atom or an oxygen atom. $R_1$ represents an aryl group or an alkyl group. $R_2$-$R_4$ each represent a hydrogen atom, an alkyl group, an aryl group, an alkoxy group, a phenoxy group, an alkylthio group, a phenylthio group, or a dialkylamino group. M represents a metal atom. Y represents non-substitution or an alkyl group, an alkoxy group, an aryloxy group, a halogen atom, an oxygen atom, or a hydroxyl group.

(I)

(II)

4 Claims, No Drawings

ELECTROPHOTOGRAPHIC PHOTOSENSITIVE MEMBER

INCORPORATION BY REFERENCE

The present application claims priority under 35 U.S.C. §119 to Japanese Patent Application No. 2014-106721, filed May 23, 2014. The contents of this application are incorporated herein by reference in their entirety.

BACKGROUND

The present disclosure relates to electrophotographic photosensitive members.

Electrophotographic photosensitive members used in electrophotographic image forming apparatuses for example include inorganic photosensitive members having a photosensitive layer made from an inorganic material (specific examples include selenium and amorphous silicon) and organic photosensitive members having a photosensitive layer containing an organic material (specific examples include binder resins, charge generating materials, and charge transport materials) as a main component of a photosensitive material. Organic photosensitive members such as described above are favorably used as they are known to be easier to manufacture than inorganic photosensitive members and are also known to provide a large amount of design freedom due the large number of photosensitive materials that can be selected for inclusion in the photosensitive layer.

Examples of electrophotographic photosensitive members such as described above that have been proposed include a photosensitive member having a charge transport layer that contains a sulfonic acid-containing phthalocyanine pigment and a photosensitive member having a charge transport layer that contains a silicon naphthalocyanine pigment.

SUMMARY

An electrophotographic photosensitive member according to the present disclosure includes a conductive substrate and a photosensitive layer. The photosensitive layer is located either directly or indirectly on the conductive substrate. The photosensitive layer contains at least a charge generating material, a charge transport material, and a binder resin. The photosensitive layer includes a charge generating layer and a charge transport layer located on the charge generating layer. The charge transport layer contains a pigment. The pigment is absorptive with respect to a wavelength of exposed light. The pigment is a metal phthalocyanine pigment represented by General Formula (I) or a metal-free phthalocyanine pigment represented by General Formula (II).

(I)

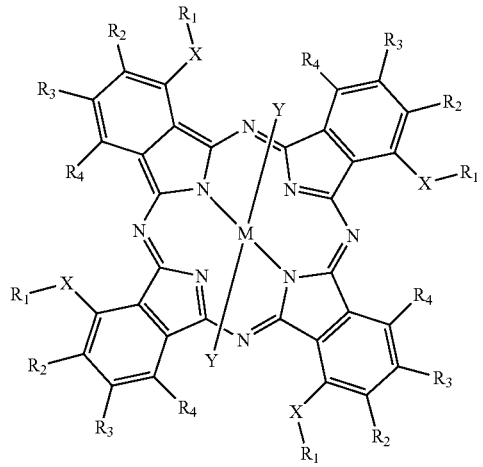

(II)

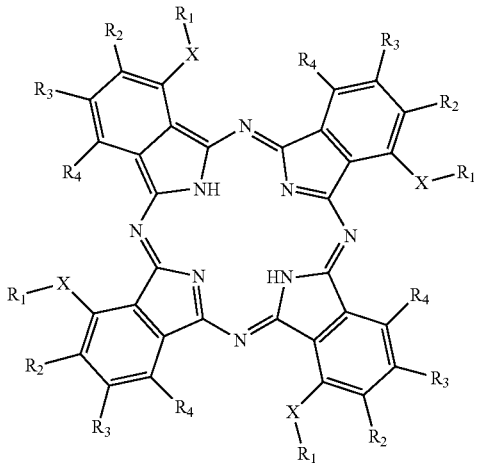

In General Formula (I) and General Formula (II), X represents a sulfur atom or an oxygen atom. $R_1$ represents an optionally substituted aryl group or an alkyl group. $R_2$ to $R_4$ each represent, independently of one another, a hydrogen atom, an optionally substituted alkyl group, an aryl group, an alkoxy group, an optionally substituted phenoxy group, an alkylthio group, an optionally substituted phenylthio group, or a dialkylamino group. In General Formula (I), M represents a metal atom. Y represents non-substitution or represents an optionally substituted alkyl group, an alkoxy group, an aryloxy group, a halogen atom, an oxygen atom, or a hydroxyl group.

DETAILED DESCRIPTION

The following explains an embodiment of the present disclosure, but the present disclosure is of course not limited to the embodiment.

<<Electrophotographic Photosensitive Member (Photosensitive Member)>>

An electrophotographic photosensitive member (also referred to below simply as a photosensitive member) according to the embodiment of the present disclosure includes a conductive substrate and a photosensitive layer located either directly on the conductive substrate or indirectly on the conductive substrate with an underlayer (intermediate layer) therebetween. The photosensitive layer includes a charge generating layer and a charge transport layer located on the charge generating layer. Thus, the photosensitive member according to the present embodiment is a multi-layer photosensitive member.

A feature of the present embodiment is that the charge transport layer contains a pigment that is absorptive with respect to a wavelength of exposed light and that is a metal phthalocyanine pigment represented by General Formula (I) or a metal-free phthalocyanine pigment represented by General Formula (II).

So long as the photosensitive member according to the present embodiment includes the conductive substrate and the photosensitive layer, no other particular limitations are placed thereon. In the photosensitive member according to the present embodiment, the photosensitive layer may for example be located directly on the conductive substrate. The photosensitive member according to the present embodiment may further include an intermediate layer (more specifically, an underlayer or the like) or a protective layer. The intermediate layer may for example be located between the conductive substrate and the photosensitive layer, or may be located between the charge transport layer and the charge generating layer. Also, the photosensitive member may be exposed as an outermost layer in the photosensitive member according to the present embodiment. Alternatively, the photosensitive member according to the present embodiment may include a protective layer that is located on the photosensitive layer.

{Conductive Substrate}

No particular limitations are places on the conductive substrate other than being a conductive substrate that can be used in a photosensitive member. The conductive substrate can for example be a conductive substrate in which at least a surface portion thereof is made from a conductive material. Examples of the conductive substrate include conductive substrates made from a conductive material and conductive substrates having a coating of a conductive material. Examples of conductive materials that can be used include aluminum, iron, copper, tin, platinum, silver, vanadium, molybdenum, chromium, cadmium, titanium, nickel, palladium, indium, stainless steel, and brass. Any one of the conductive materials listed above may be used or a combination (for example, an alloy) of any two or more of the conductive materials listed above may be used. Among the conductive materials listed above, aluminum or an aluminum alloy is preferable in terms of good movement of charge from the photosensitive layer to the conductive substrate.

The conductive substrate is not limited to being any particular shape and the shape thereof can be selected appropriately in accordance with the structure of an image forming apparatus in which the conductive substrate is to be used. The conductive substrate is for example a sheet or a drum. Thickness of the conductive substrate can be selected as appropriate in accordance with the shape of the conductive substrate.

{Photosensitive Layer}

The photosensitive layer contains at least a charge generating material, a charge transport material, and one or more binder resins. The charge generating layer for example includes a charge generating material and a binder resin. The charge transport layer for example includes a charge transport material (more specifically, a hole transport material or the like), a binder resin, and a pigment. The following explains the binder resins, the charge generating material, the charge transport material, and the pigment.

(Binder Resins)

Binder resins contained in the photosensitive member for example include a binder resin contained in the charge transport layer and a binder resin contained in the charge generating layer. In the following explanation, the binder resin contained in the charge generating layer is referred to as a charge generating layer binder resin and the binder resin contained in the charge transport layer is referred to as a charge transport layer binder resin.

No particular limitations are placed on the charge transport layer binder resin other than being a binder resin that can be contained in a charge transport layer of a photosensitive member such as a thermoplastic resin, a thermosetting resin, or a photocurable resin. Examples of thermoplastic resins that can be used include styrene-based resins, styrene-butadiene copolymers, styrene-acrylonitrile copolymers, styrene-maleic acid copolymers, styrene-acrylic acid copolymers, acrylic copolymers, polyethylene resins, ethylene-vinyl acetate copolymers, chlorinated polyethylene resins, polyvinyl chloride resins, polypropylene resins, ionomers, vinyl chloride-vinyl acetate copolymers, polyester resins, alkyd resins, polyamide resins, urethane resins, polycarbonate resins, polyarylate resins, polysulfone resins, diallyl phthalate resins, ketone resins, polyvinyl butyral resins, and polyether resins. Examples of thermosetting resins that can be used include silicone resins, epoxy resins, phenolic resins, urea resins, melamine resins, and other crosslinkable thermosetting resins. Examples of photocurable resins that can be used include epoxy acrylate resins and urethane-acrylate copolymer resins. Among the resins listed above, polycarbonate resins are preferable. The charge transport layer binder resin may be any one of the resins listed above or may be a combination of any two or more of the resins listed above.

No particular limitations are placed on the charge generating layer binder resin other than being a binder resin that can be contained in a charge generating layer. Examples of the charge generating layer binder resin include styrene-butadiene copolymers, styrene-acrylonitrile copolymers, styrene-maleic acid copolymers, acrylic copolymers, styrene-acrylic acid copolymers, polyethylene resins, ethylene-vinyl acetate copolymers, chlorinated polyethylene resins, polyvinyl chloride resins, polypropylene resins, ionomer resins, vinyl chloride-vinyl acetate copolymers, alkyd resins, polyamide resins, urethane resins, polysulfone resins, diallyl phthalate resins, ketone resins, polyvinyl acetal resins, polyvinyl butyral resins, polyether resins, silicone resins, epoxy resins, phenolic resins, urea resins, melamine resins, epoxy acrylate resins, and urethane-acrylate resins. The charge generating layer binder resin may be any one of the resins listed above or may be a combination of any two or more of the resins listed above.

Note that although many of the same examples are given for the charge generating layer binder resin and the charge transport layer binder resin, typically a charge generating layer binder resin and a charge transport layer binder resin included in the same photosensitive member are selected so as to be different binder resins to one another. The following provides an explanation of the above statement. In manufacture of a multi-layer photosensitive member, a charge generating layer and a charge transport layer are normally formed in stated order and thus an application liquid for charge transport layer formation is normally coated onto the charge generating layer. As a consequence, the charge generating layer is required to be insoluble in a solvent of the application liquid for charge transport layer formation. Therefore, a charge generating layer binder resin is normally selected to be a different resin to a charge transport layer binder resin included in the same photosensitive member.

(Charge Generating Material)

No particular limitations are placed on the charge generating material other than being a charge generating material that can be used in a photosensitive member. Examples of charge generating materials that can be used include phthalocyanine-based pigments, perylene pigments, bisazo pigments, dithioketopyrrolopyrrole pigments, naphthalocyanine-based pigments (specific examples include metal-free naphthalocyanine pigments and metal naphthalocyanine pigments), squaraine pigments, tris-azo pigments, indigo pigments, azulenium pigments, cyanine pigments, powders of inorganic photoconductive materials such as selenium, selenium-tellurium, selenium-arsenic, cadmium sulfide, and amorphous silicon, pyrylium salts, anthanthrone-based pigments, triphenylmethane-based pigments, threne-based pigments, toluidine-based pigments, pyrazoline-based pigments, and quinacridone-based pigments. Examples of phthalocyanine-based pigments include metal-free phthalocyanine pigments (specific examples include X-form metal-free phthalocyanine (X-$H_2$Pc)) and metal phthalocyanine pigments (specific examples include Y-form titanyl phthalocyanine (Y-TiOPc)).

A single charge generating material having an absorption wavelength in a desired region or a combination of two or more charge generating materials may be used. Also, for example in a digital optical system image forming apparatus (for example, a laser beam printer or facsimile machine in which a light source such as a semiconductor laser is used), the charge generating material is preferably selected from the above examples such that the photosensitive member is sensitive to a range of wavelengths that are greater than or equal to 700 nm. Therefore, in such a situation, a phthalocyanine-based pigment is for example preferably used. Note that a phthalocyanine-based pigment may have various different crystal forms and no particular limitation is placed thereon. A particularly preferable example of the charge generating material is titanyl phthalocyanine exhibiting a major peak at a Bragg angle 2θ of 27.2° with respect to characteristic X-rays of CuKα (wavelength 1.541 Å).

The term major peak refers to a most intense or second most intense peak within a range of Bragg angles (2θ) from 3° to 40° in a CuKα characteristic X-ray diffraction spectrum.

An example of a method for measuring the CuKα characteristic X-ray diffraction spectrum is explained below. A sample (titanyl phthalocyanine) is loaded into a sample holder of an X-ray diffraction spectrometer (for example, a RINT 1100 produced by Rigaku Corporation) and an X-ray diffraction spectrum is measured using a Cu X-ray tube, a tube voltage of 40 kV, a tube current of 30 mA, and X-rays characteristic of CuKα having a wavelength of 1.541 Å. The measurement range (2θ) is for example from 3° to 40° (start angle: 3°, stop angle: 40°) and the scanning speed is for example 10°/minute. Major peaks are determined in the X-ray diffraction spectrum that is obtained and the Bragg angle of each major peak is read from the X-ray diffraction spectrum.

For a photosensitive member in an image forming apparatus that uses a short-wavelength laser light source (for example, a laser light source having an approximate wavelength of at least 350 nm and no greater than 550 nm), the charge generating material is for example preferably an anthanthrone-based pigment or a perylene-based pigment.

(Charge Transport Material)

The charge transport material is typically a hole transport material or an electron transport material, but no particular limitations are placed on the charge transport material other than being a charge transport material that can be contained in a photosensitive layer of an electrophotographic photosensitive member.

Also, no particular limitations are placed on the hole transport material other than being a hole transport material that can be used in a photosensitive member. In consideration of matching the hole transport material to the charge transport layer binder resin, the hole transport material is preferably a compound represented by General Formula (III), General Formula (IV), or General Formula (V).

(III)

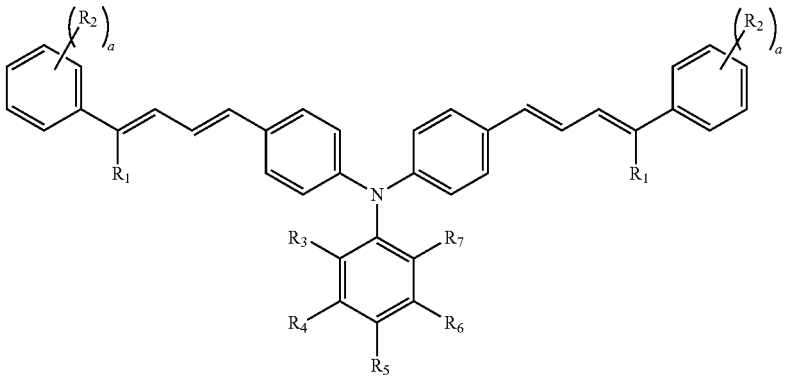

In General Formula (III), $R_1$ and $R_3$ to $R_7$ each represent, independently of one another, a hydrogen atom, an alkyl group having a carbon number of at least 1 and no greater than 8, an optionally substituted phenyl group, or an alkoxy group. In General Formula (III), $R_2$ represents an alkyl group having a carbon number of at least 1 and no greater than 8, a phenyl group, or an alkoxy group. Members among $R_3$ to $R_7$ may be bonded to one another to form a ring. However, in such a structure, the ring is formed by bonding of members among $R_3$ to $R_7$ that are bonded to adjacent carbon atoms in a benzene ring. In General Formula (III), a represents an integer of at least 0 and no greater than 5.

In General Formula (III), an alkyl group having a carbon number of at least 1 and no greater than 8 that is represented by any of $R_1$ to $R_7$ may be a straight chain alkyl group or a branched alkyl group. The alkyl group having a carbon number of at least 1 and no greater than 8 may for example be a methyl group, an ethyl group, an n-propyl group, an isopropyl group, an n-butyl group, an isobutyl group, a sec-butyl group, a tert-butyl group, a pentyl group, a neopentyl group, an isopentyl group, an n-hexyl group, a 2-methylpentyl group, a heptyl group, or an octyl group. Among the alkyl groups listed above, a methyl group, an ethyl group, or an n-butyl group is preferable. The alkyl group preferably has a carbon number of at least 1 and no greater than 6, and more preferably has a carbon number of at least 1 and no greater than 4. The alkyl group may be optionally substituted. The alkyl group may for example have a halogen atom, a hydroxyl group, an alkoxy group having a carbon number of at least 1 and no greater than 4, or a cyano group as a substituent.

An alkoxy group represented by any of $R_1$ to $R_7$ in General Formula (III) may be a straight chain alkoxy group or a branched alkoxy group. The alkoxy group may for example be a methoxy group, an ethoxy group, an n-propoxy group, an isopropoxy group, an n-butoxy group, a sec-butoxy group, a t-butoxy group, an n-pentoxy group, an n-hexoxy group, an n-heptoxy group, or an n-octoxy group. Among the alkoxy groups listed above, a methoxy group is preferable. The alkoxy group preferably has a carbon number of at least 1 and no greater than 8, more preferably has a carbon number of at least 1 and no greater than 6, and particularly preferably has a carbon number of at least 1 and no greater than 4. The alkoxy group may be optionally substituted. The alkoxy group may for example have a halogen atom, a hydroxyl group, an alkoxy group having a carbon number of at least 1 and no greater than 4, or a cyano group as a substituent.

A phenyl group represented by any of $R_1$ to $R_7$ in General Formula (III) may be optionally substituted. The phenyl group may for example have a halogen atom, a hydroxyl group, an alkyl group having a carbon number of at least 1 and no greater than 4 (preferably a methyl group), an alkoxy group having a carbon number of at least 1 and no greater than 4, a nitro group, a cyano group, an aliphatic acyl group having a carbon number of at least 2 and no greater than 4, a benzoyl group, a phenoxy group, an alkoxycarbonyl group including an alkoxy group having a carbon number of at least 1 and no greater than 4, a phenoxycarbonyl group, or an arylalkenyl group (for example, a phenylethenyl group) as a substituent. A phenyl group represented by any of $R_1$ to $R_7$ in General Formula (III) is preferably an alkylphenyl group and is more preferably a p-methylphenyl group.

In General Formula (III), the two symbols $R_1$ may both be the same or may each be different. In General Formula (III), members among $R_3$ to $R_7$ may be bonded to form a ring. However, in such a structure, the ring is formed by bonding of members among $R_3$ to $R_7$ that are bonded to adjacent carbon atoms in a benzene ring. A ring formed by any of $R_3$ to $R_7$ may for example be a cyclohexane ring or a cyclopentane ring.

In General Formula (III), $R_1$ and $R_3$ to $R_7$ each preferably represent a hydrogen atom, an alkyl group having a carbon number of at least 1 and no greater than 8, or an alkoxy group, and more preferably represent a hydrogen atom, a methyl group, an ethyl group, an n-butyl group, or a methoxy group.

In General Formula (III), a represents an integer of at least 0 and no greater than 5, preferably represents an integer of at least 0 and no greater than 3, and more preferably represents 0 or 1. Note that a indicates the number of functional groups $R_2$ that are present. The functional groups are one or more functional groups selected from the group consisting of an alkyl group having a carbon number of at least 1 and no greater than 8, an optionally substituted phenyl group, and an alkoxy group. In General Formula (III), the two symbols a may both be the same or may be different. When the sum of the integers represented by the two symbols a is at least 2, each $R_2$ in General Formula (III) may be the same or each $R_2$ may be different.

(IV)

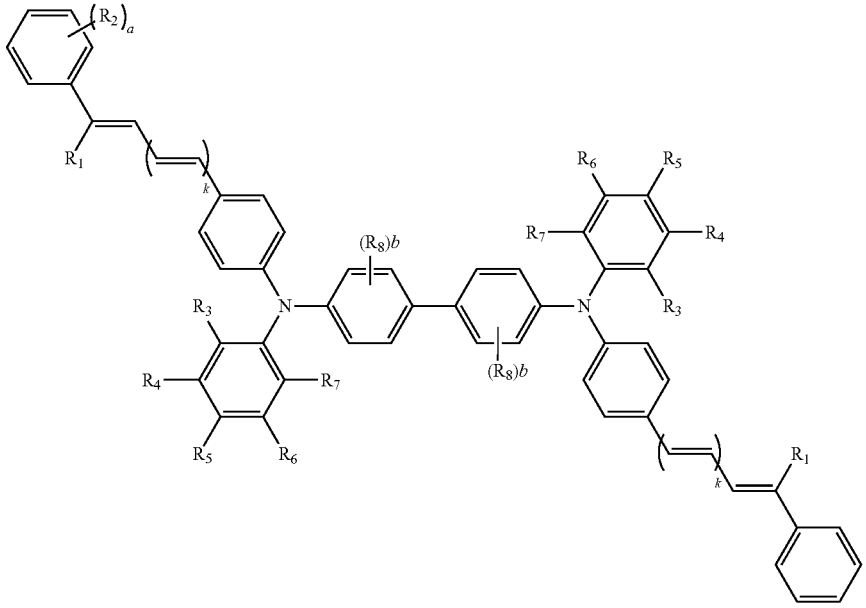

In General Formula (IV), $R_1$ and $R_3$ to $R_7$ each represent, independently of one another, a hydrogen atom, an alkyl group having a carbon number of at least 1 and no greater than 8, or a phenyl group. In General Formula (IV), a represents an integer of at least 0 and no greater than 5. In General Formula (IV), $R_2$ and $R_8$ each represent, independently of one another, an alkyl group having a carbon number of at least 1 and no greater than 8 or a phenyl group. In General Formula (IV), a represents an integer of at least 0 and no greater than 5. In General Formula (IV), b represents an integer of at least 0 and no greater than 4. In General Formula (IV), k represents 0 or 1.

Examples of the alkyl group having a carbon number of at least 1 and no greater than 8 and the phenyl group that may be represented by $R_1$ to $R_8$ in General Formula (IV) are the same as defined for the alkyl group having a carbon number of at least 1 and no greater than 8 and the phenyl group that may be represented by $R_1$ to $R_7$ in General Formula (III). In General Formula (IV), the two symbols $R_1$, $R_3$, $R_4$, $R_5$, $R_6$, or $R_7$ may both be the same or may each be different.

In General Formula (IV), $R_1$ and $R_3$ to $R_7$ each preferably represent a hydrogen atom or an alkylphenyl group, and more preferably represent a hydrogen atom or an ethyl methyl phenyl group.

In General Formula (IV), a represents an integer of at least 0 and no greater than 5, preferably represents an integer of at least 0 and no greater than 3, and more preferably represents 0 or 1. Note that a indicates the number of functional groups $R_2$ that are present. The functional groups are one or more functional groups from among an alkyl group having a carbon number of at least 1 and no greater than 8 and a phenyl group. In General Formula (IV), the two symbols a may both be the or may be different. When the sum of the integers represented by the two symbols a is at least 2, each $R_2$ in General Formula (IV) may be the same or each $R_2$ may be different.

In General Formula (IV), b represents an integer of at least 0 and no greater than 4, and preferably represents an integer of at least 0 and no greater than 2. Note that b indicates the number of functional groups $R_8$ that are present. The functional groups are one or more functional groups among an alkyl group having a carbon number of at least 1 and no greater than 8 and a phenyl group. In General Formula (IV), the two symbols b may both be the same or may each be different. When the sum of the integers represented by the two symbols b is at least 2, each $R_8$ in General Formula (IV) may be the same or each $R_8$ may be different. In General Formula (IV), k represents 0 or 1. In General Formula (IV), the two symbols k may both be the same or may each be different.

In General Formula (V), Ra, Rb, and Rc each represent, independently of one another, an alkyl group having a carbon number of at least 1 and no greater than 8, a phenyl group, or an alkoxy group. In General Formula (V), k represents an integer of at least 0 and no greater than 4. In General Formula (V), m and n each represent, independently of one another, an integer of at least 0 and no greater than 5.

Examples of the alkyl group having a carbon number of at least 1 and no greater than 8, the phenyl group, and the alkoxy group that may be represented by Ra, Rb, and Rc in General Formula (V) are the same as defined for the alkyl group having a carbon number of at least 1 and no greater than 8, the phenyl group, and the alkoxy group that may be represented by $R_1$ to $R_7$ in General Formula (III). In General Formula (V), Ra, Rb, and Rc each preferably represent an alkyl group having a carbon number of at least 1 and no greater than 8, and more preferably represent a methyl group or an ethyl group.

In General Formula (V), k represents an integer of at least 0 and no greater than 4, and preferably represents an integer of at least 0 and no greater than 2. Note that k indicates the number of functional groups Rc that are present. The functional groups are one or more functional groups selected from the group consisting of an alkyl group having a carbon number of at least 1 and no greater than 8, a phenyl group, and an alkoxy group. In General Formula (V), the two symbols k may both be the same or may each be different. When the sum of the integers represented by the two symbols k is at least 2, each Rc in General Formula (V) may be the same or each Rc may be different.

In General Formula (V), m and n each represent, independently of one another, an integer of at least 0 and no greater than 5, and preferably represent an integer of at least 0 and no greater than 2. Note that m and n respectively indicate the number of functional groups Rb and the number of functional groups Ra. The functional groups are one or more functional groups selected from the group consisting of an alkyl group having a carbon number of at least 1 and no greater than 8, a phenyl group, and an alkoxy group. In General Formula (V), the two symbols m and the two symbols n may both be the same or may each be different. When the sum of the integers represented by the two symbols m is at least 2, each Rb in General Formula (V) may be the same or each Rb may be different. When the sum of (V)

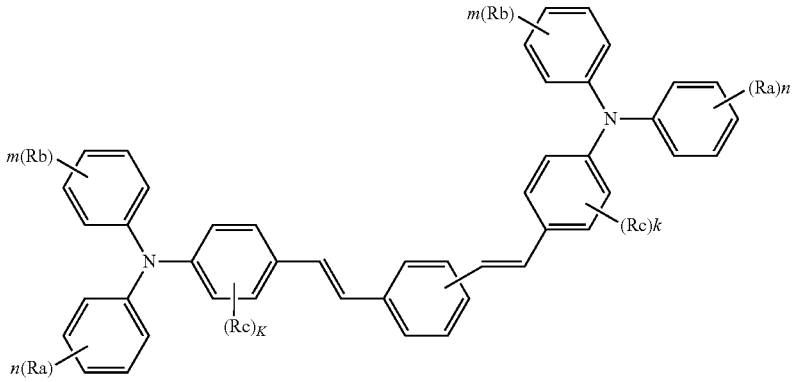

the integers represented by the two symbols n is at least 2, each Ra in General Formula (V) may be the same or each Ra may be different.

The compounds represented by General Formula (III), General Formula (IV), and General Formula (V) can be manufactured according to various different methods. For example, the compound represented by General Formula (III) can be manufactured based on the contents of Japanese Patent Application Laid-Open Publication No. 2005-289877, the compound represented by General Formula (W) can be manufactured based on the contents of Japanese Patent Application Laid-Open Publication No. 2006-008670, and the compound represented by General Formula (V) can be manufactured based on the contents of Japanese Patent Application Laid-Open Publication No. 2000-239236.

One of the compounds represented by General Formula (III), General Formula (IV), and General Formula (V) may be used as the hole transport material or a combination of any two or more of the aforementioned compounds may be used as the hole transport material. The hole transport material may further contain another hole transport material that is not a compound represented by General Formula (III), General Formula (IV), or General Formula (V). Examples of other hole transport materials that can be used include benzidine derivatives, oxadiazole-based compounds such as 2,5-di(4-methylaminophenyl)-1,3,4-oxadiazole, styryl-based compound such as 9-(4-diethylaminostyryl)anthracene, carbazole-based compounds such as polyvinyl carbazole, organic polysilane compounds, pyrazoline-based compounds such as 1-phenyl-3-(p-dimethylaminophenyl) pyrazoline, hydrazone-based compounds, triphenyl amine-based compounds, nitrogen containing cyclic compounds such indole-based compounds, oxazole-based compounds, isoxazole-based compounds, thiazole-based compounds, thiadiazole-based compounds, imidazole-based compounds, pyrazole-based compounds, and triazole-based compounds, and condensed polycyclic compounds. Among the other hole transport materials listed above, a triphenyl amine-based compound or a benzidine derivative is preferable, with the benzidine derivative being more preferable. Any one of the materials listed above may be used as the other hole transport material or a combination of any two or more of the materials listed above may be used as the other hole transport material.

No particular limitations are placed on the electron transport material other than being an electron transport material that can be used in a photosensitive member. Examples of electron transport materials that can be used include quinone derivatives, naphthoquinone derivatives, anthraquinone derivatives, malononitrile derivatives, thiopyran derivatives, trinitrothioxanthone derivatives, 3,4,5,7-tetranitro-9-fluorenone derivatives, dinitroanthracene derivatives, dinitroacridine derivatives, nitroanthraquinone derivatives, dinitroanthraquinone derivatives, tetracyanoethylene, 2,4,8-trinitrothioxanthone, dinitrobenzene, dinitroanthracene, dinitroacridine, nitroanthraquinone, dinitroanthraquinone, succinic anhydride, maleic anhydride, and dibromomaleic anhydride. Any of the materials listed above may be used as the electron transport material or a combination of any two or more of the materials listed above may be used as the electron transport material.

(Pigment)

The pigment is absorptive with respect to a wavelength of exposed light. The pigment is a metal phthalocyanine pigment represented by General Formula (I) or a metal-free phthalocyanine pigment represented by General Formula (II) (also referred to below simply as a phthalocyanine pigment).

(I)

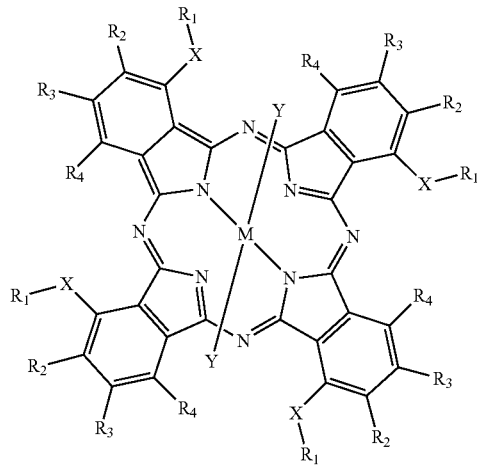

(II)

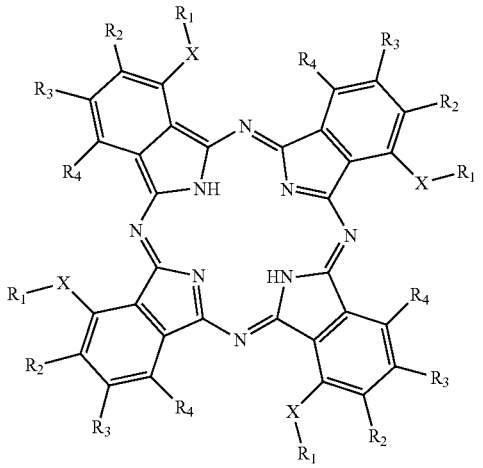

In General Formula (I) and General Formula (II), X represents a sulfur atom or an oxygen atom. $R_1$ represents an optionally substituted aryl group or an alkyl group. $R_2$ to $R_4$ each represent, independently of one another, a hydrogen atom, an optionally substituted alkyl group, an aryl group, an alkoxy group, an optionally substituted phenoxy group, an alkylthio group, an optionally substituted phenylthio group, or a dialkylamino group. In General Formula (I), M represents a metal atom. Y represents non-substitution or represents an optionally substituted alkyl group, an alkoxy group, an aryloxy group, a halogen atom, an oxygen atom, or a hydroxyl group.

In General Formula (I) and General Formula (II), X represents a sulfur atom or an oxygen atom. In General Formula (I) and General Formula (II), the four symbols X may each be the same or may each be different.

An aryl group represented by any of $R_1$ to $R_4$ in General Formula (I) and General Formula (II) may for example be a phenyl group, a group formed through condensation of two or three benzene rings, or a group including two or three benzene rings connected by single bonds. Specific examples of the aryl group include a phenyl group, a naphthyl group, a biphenylyl group, a benzil group, a tolyl group, and a xylyl group. The number of benzene rings included in the aryl group is preferably at least 1 and no greater than 3, and is more preferably 1. The aryl group may be optionally substituted. The aryl group may for example have a halogen atom, a hydroxyl group, an alkyl group having a carbon number of at least 1 and no greater than 4 (specific examples include a methyl group, an ethyl group, a propyl group, and an isopropyl group), an alkoxy group having a carbon number of at least 1 and no greater than 4, a nitro group, a cyano group, an aliphatic acyl group having a carbon number of at least 2 and no greater than 4, a benzoyl group, a phenoxy group, an alkoxycarbonyl group including an alkoxy group having a carbon number of at least 1 and no greater than 4, a phenoxycarbonyl group, or an arylalkenyl group (specific examples include a phenylethenyl group) as a substituent. Among the substituents listed above, a substituent of the aryl group is preferably a methyl group or a methoxy group. The aryl group has at least one substituent and preferably has a least one and no greater than three substituents. An aryl group represented by any of $R_1$ to $R_4$ in General Formula (I) and General Formula (II) is preferably an optionally substituted phenyl group and is more preferably a dimethylphenyl group.

An alkyl group represented by any of $R_1$ to $R_4$ in General Formula (I) and General Formula (II) may be a straight chain alkyl group or a branched alkyl group. The alkyl group may for example be a methyl group, an ethyl group, an n-propyl group, an isopropyl group, an n-butyl group, an isobutyl group, a sec-butyl group, a tert-butyl group, a pentyl group, a neopentyl group, an isopentyl group, an n-hexyl group, a 2-methylpentyl group, a heptyl group, or an octyl group. The alkyl group preferably has a carbon number of at least 1 and no greater than 8, and more preferably has a carbon number of at least 1 and no greater than 6. The alkyl group may for example have a halogen atom, a hydroxyl group, an alkoxy group having a carbon number of at least 1 and no greater than 4, or a cyano group as a substituent.

A dialkylamino group represented by any of $R_2$ to $R_4$ in General Formula (I) and General Formula (II) is a group resulting from substitution of two hydrogen atoms of an amino group with two alkyl groups among the examples of the alkyl group that may be represented by $R_1$ to $R_4$ in General Formula (I) and General Formula (II). The two alkyl groups may both be the same or may each be a different alkyl group. The dialkylamino group may for example be a dimethylamino group.

Examples of the alkoxy group that may be represented by $R_2$ to $R_4$ in General Formula (I) and General Formula (II) are the same as defined for the alkoxy group that may be represented by $R_1$ to $R_7$ in General Formula (III). The optionally substituted phenoxy group and the optionally substituted phenylthio group that may be represented by $R_2$ to $R_4$ in General Formula (I) are groups formed through bonding of any of the examples of the phenyl group that may be represented by $R_1$ to $R_7$ in General Formula (III) with an oxygen atom or a sulfur atom respectively. The optionally substituted phenoxy group that may be represented by $R_2$ to $R_4$ in General Formula (I) and General Formula (II) is preferably an alkylphenoxy group and is more preferably an o-methylphenoxy group. The optionally substituted phenylthio group that may be represented by $R_2$ to $R_4$ in General Formula (I) and General Formula (II) is preferably an unsubstituted phenylthio group, an alkylphenylthio group, or an alkoxyphenylthio group, and is more preferably a phenylthio group, a p-methylphenylthio group, or a p-methoxyphenylthio group. The alkylthio group that may be represented by $R_2$ to $R_4$ in General Formula (I) and General Formula (II) is a group formed by one end of any of the examples of the alkyl group that may be represented by $R_1$ to $R_4$ in General Formula (I) and General Formula (II) bonding to a sulfur atom.

In General Formula (I) and General Formula (II), the four symbols $R_1$ may each be the same or may each be different. Likewise, the four symbols $R_2$, the four symbols $R_3$, and the four symbols $R_4$ may each be the same or may each be different. In General Formula (I) and General Formula (II), $R_1$ preferably represents an optionally substituted aryl group, more preferably represents an optionally substituted phenyl group, and particularly preferably represents a dimethylphenyl group or a p-methoxyphenyl group. In General Formula (I) and General Formula (II), $R_2$ to $R_4$ preferably each represent a hydrogen atom, an optionally substituted phenoxy group, an optionally substituted phenylthio group, or a dialkylamino group, and more preferably represent a hydrogen atom, an o-methylphenoxy group, a p-methoxyphenylthio group, or a dimethylamino group.

In General Formula (I), there is no particular limitation on the metal atom represented by M. The metal atom may for example be Si, Ge, Sn, Cu, Zn, Mg, Ti, V, Al, In, or Pb, and is preferably Zn, Cu, or Pb.

Examples of halogen atoms that may be represented by Y in General Formula (I) include a fluorine atom, a chlorine atom, a bromine atom, and an iodine atom. The aryloxy group that may be represented by Y in General Formula (I) is a group in which an oxygen atom is bonded to any of the examples of the aryl group that may be represented by $R_1$ to $R_4$ in General Formula (I). Examples of the alkyl group that may be represented by Y in General Formula (I) are the same as defined for the alkyl group that may be represented by $R_1$ to $R_4$ in General Formula (I). Examples of the alkoxy group that may be represented by Y in General Formula (I) are the same as defined for the alkoxy group that may be represented by $R_2$ to $R_4$ in General Formula (I). Y preferably represents non-substitution. In General Formula (I), the two symbols Y may both be same or may each be different.

The metal phthalocyanine pigment represented by General Formula (I) or the metal-free phthalocyanine pigment represented by General Formula (II) can for example be manufactured based on a method recited in Japanese Patent Application Laid-Open Publication No. 2009-051774. Detailed explanation is provided in the Examples.

The pigment may further contain another pigment other than the metal phthalocyanine pigment represented by General Formula (I) or the metal-free phthalocyanine pigment represented by General Formula (II).

(Additives)

The photosensitive member may contain various additives so long as such additives do not adversely affect electrophotographic characteristics and abrasion resistance of the photosensitive member. Examples of additives that can be used include antidegradants (specific examples include antioxidants, radical scavengers, singlet quenchers, and ultraviolet absorbing agents), softeners, plasticizers, surface modifiers, extending agents, thickeners, dispersion stabilizers, waxes, acceptors, donors, surfactants, and leveling agents. Also, a sensitizer (specific examples include terphenyl, halonaphthoquinones, and acenaphthylene) may be used in combination with the charge generating material in order to improve sensitivity of the photosensitive layer.

In the present embodiment, the charge transport layer preferably has a transmittance of at least more than 5% and no greater than 80% with respect to a wavelength of exposed light, and more preferably has a transmittance of at least 10% and no greater than 70%.

The transmittance can be measured as described below. An application liquid for charge transport layer formation is applied onto non-reflective glass and is dried thereon to obtain non-reflective glass with an applied film thereon. Transmittance of the applied film with respect to light having a wavelength of 780 nm is obtained by measuring a transmittance of the non-reflective glass itself and a transmittance of the non-reflective glass with the applied film thereon using a spectrometer and by calculating a difference between the measured transmittances.

<<Photosensitive Member Production Method>>

The following explains a method for producing the photosensitive member.

The photosensitive member is for example produced according to the method described below.

The photosensitive member is produced by forming the charge generating layer and the charge transport layer on the conductive substrate. The charge generating layer is formed by applying an application liquid for charge generating layer formation and subsequently drying the application liquid. The charge transport layer is formed by applying an application liquid for charge generating layer formation and subsequently drying the application liquid. More specifically, the application liquid for charge generating layer formation and the application for the charge transport layer (also referred to below simply as application liquids) are first prepared. The application liquid for charge generating layer formation can be prepared through dissolution or dispersion of the charge generating material, the charge generating layer binder resin, and additives in accordance with necessity thereof in a solvent. The application liquid for charge transport layer formation can be prepared through dissolution or dispersion of the charge transport material, the charge transport layer binder resin, the phthalocyanine pigment, and additives in accordance with necessity thereof in a solvent. Next, the application liquid for charge generating layer formation is applied onto the conductive substrate and is dried thereon to form the charge generating layer. The application liquid for charge transport layer formation is subsequently applied onto the charge generating layer that has been formed on the conductive substrate and is dried thereon to form the charge transport layer. Through the process described above, the photosensitive member can be produced.

Amounts of the charge generating material, the charge transport material, the phthalocyanine pigment, the charge generating layer binder resin, and the charge transport layer binder resin that are contained in the photosensitive member can be set as appropriate and no particular limitations are placed thereon. The amount of the charge generating material is preferably at least 5 parts by mass and no greater than 1,000 parts by mass relative to 100 parts by mass of the charge generating layer binder resin, and more preferably at least 30 parts by mass and no greater than 500 parts by mass.

The amount of the charge transport material is preferably at least 10 parts by mass and no greater than 500 parts by mass relative to 100 parts by mass of the charge transport layer binder resin, and more preferably at least 25 parts by mass and no greater than 100 parts by mass.

No particular limitations are placed on thicknesses of the charge generating layer and the charge transport layer so long as the thicknesses thereof are sufficient to ensure that the charge generating layer and the charge transport layer achieve their respective functions. The charge generating layer preferably has a thickness of at least 0.01 μm and no greater than 5 μm, and more preferably at least 0.1 μm and no greater than 3 μm. The charge transport layer preferably has a thickness of at least 2 μm and no greater than 100 μm, and more preferably at least 5 μm and no greater than 50 μm.

No particular limitations are placed on the solvent contained in each of the application liquids so long as the solvent enables dissolution or dispersion of each component therein. Examples of solvents that can be used include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, tetrachloromethane, and chlorobenzene), ethers (specific examples include dimethyl ether, diethyl ether, tetrahydrofuran, ethylene glycol dimethyl ether, and diethylene glycol dimethyl ether), ketones (specific examples include acetone, methyl ethyl ketone, and cyclohexanone), esters (specific examples include ethyl acetate and methyl acetate), dimethyl formaldehyde, dimethyl formamide, and dimethyl sulfoxide. Any one of the solvents listed above may be used or a combination of any two or more of the solvents listed above may be used.

Each of the application liquids is prepared by mixing the components so as to disperse the components in the solvent. The mixing or dispersion can for example be performed using a bead mill, a roll mill, a ball mill, attritor, a paint shaker, or an ultrasound disperser.

Each of the application liquids may for example contain a surfactant in order to improve dispersibility of the components.

No particular limitations are placed on the method by which the application liquids are applied so long as the method enables uniform application of the application liquid onto the conductive substrate. Examples of application methods that can be used include dip coating, spray coating, spin coating, and bar coating.

No particular limitations are placed on the method by which the application liquids are dried so long as the method enables evaporation of the solvent contained in the application liquid. The drying method may for example be heat treatment (hot-air drying) performed using a high-temperature dryer or a reduced pressure dryer. The heat treatment is for example performed for at least 3 minutes and no greater than 120 minutes at a temperature of at least 40° C. and no greater than 150° C.

The photosensitive member can be used as an image bearing member of an electrophotographic image forming apparatus. No particular limitation is placed on the image forming apparatus other than being an image forming apparatus that uses electrophotography.

EXAMPLES

The following provides more specific explanation of the present disclosure through use of Examples. Note that the present disclosure is not in any way limited by the Examples.

{Phthalocyanine Pigment Synthesis}

(Synthesis of Phthalocyanine Pigment Represented by Formula (Pigment-1))

A phthalocyanine pigment represented by Formula (Pigment-1) was synthesized according to a method recited in Japanese Patent Application Laid-Open Publication No. 2009-051774. In other words, a 20 mL pear-shaped flask equipped with a stirrer, a thermometer, and a Dimroth condenser was prepared. The pear-shaped flask was charged with 11.9 g (0.025 mol) of 3,6-bis(thiophenylmethyl)phthalonitrile (3,6-BTPMPN), 0.84 g (0.00625 mol) of copper(II) chloride, 1 L of 1-pentanol, and 20 mL of 1,8-diazabicyclo [5,4,0]-7-undecene (DBU). The contents of the pear-shaped flask were caused to react by refluxing for 7 hours at 160° C. Once the reaction was complete, the reaction liquid was cooled to room temperature (25° C.). Next, the cooled reaction liquid was poured into 10 L of methanol and a solid was caused to deposit. The deposited solid was washed by decantation twice with 2 L of pure water and twice with 2 L of methanol in the stated order to yield a crude product. The crude product was purified by silica gel column chromatography to yield 2.1 g of a dark red solid. In the silica gel column chromatography, silica gel (Silica Gel 7734 produced by Merck Ltd., particle size 0.063 mm to 0.200 mm) was used as a stationary phase and toluene was used as an eluent.

(Synthesis of Phthalocyanine Pigments Represented by Formulae (Pigment-2) to (Pigment-7))

Phthalocyanine pigments represented by Formulae (Pigment-2) to (Pigment-7) were synthesized according to the same synthetic method as the phthalocyanine pigment represented by Formula (Pigment-1).

(Pigment-1)

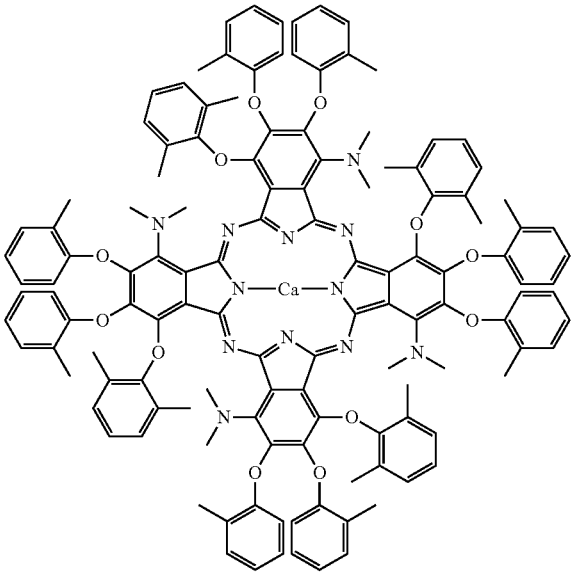

-continued (Pigment-2)

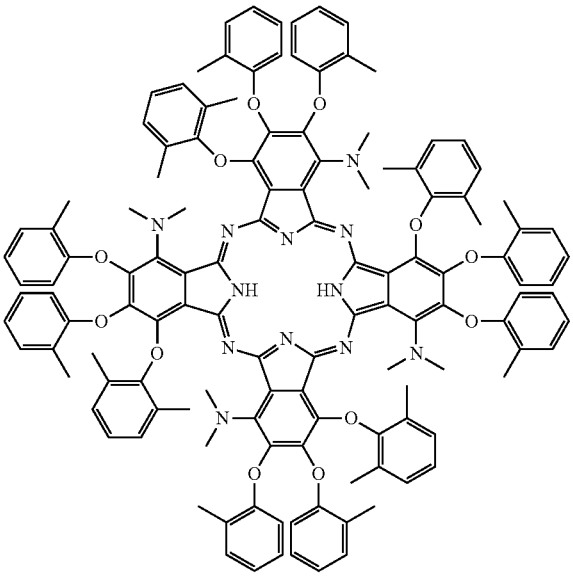

(Pigment-3)

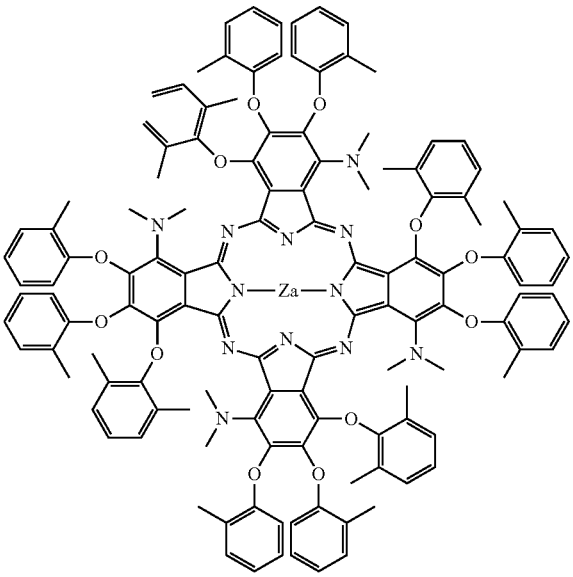

-continued
(Pigment-4)
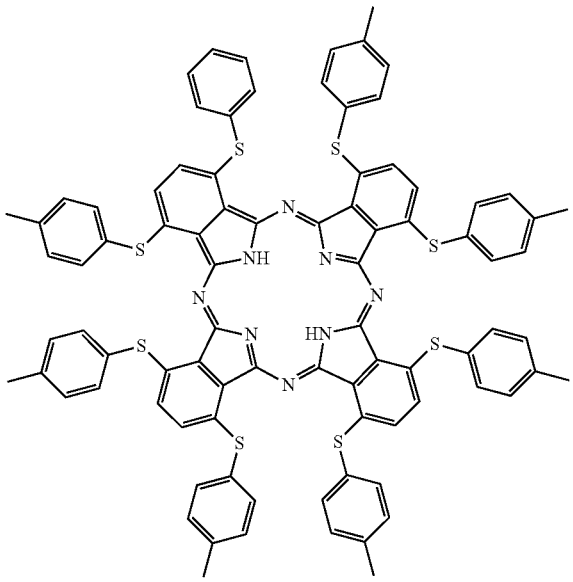
(Pigment-5)
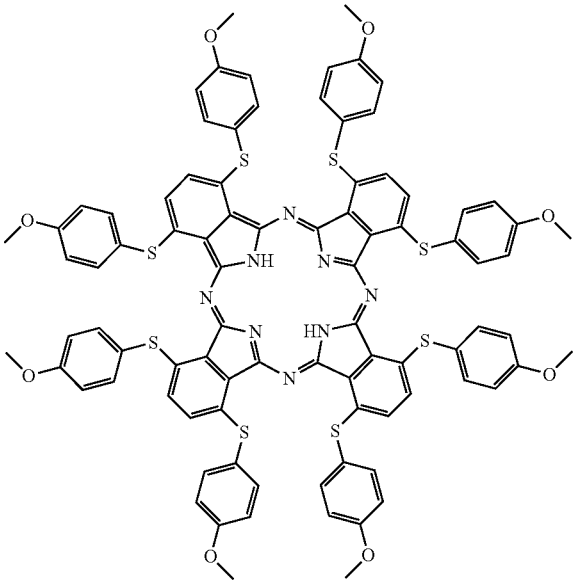
-continued
(Pigment-6)
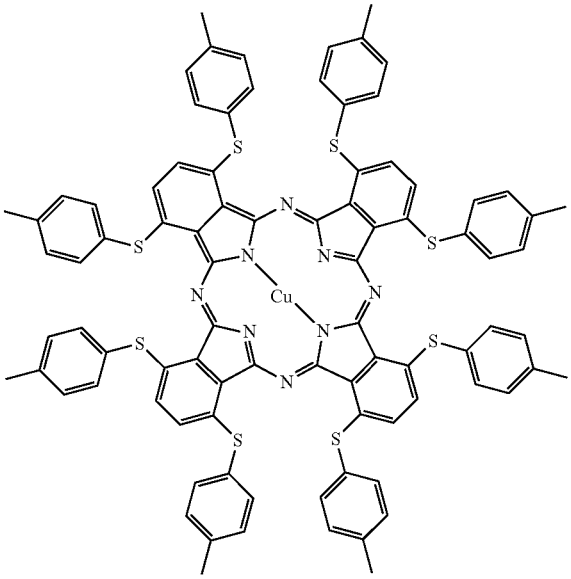
(Pigment-7)
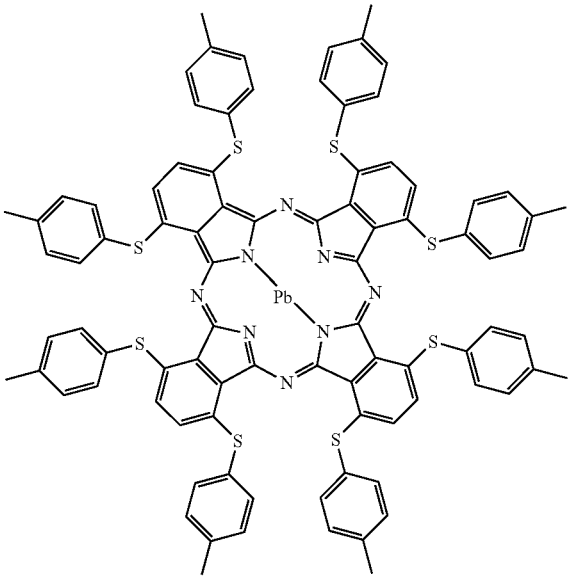
{Hole Transport Material Synthesis}
Compounds represented by Formulae (CTM-1) to (CTM-9) were synthesized according to the hole transport material synthetic method mentioned further above.
(CTM-1)
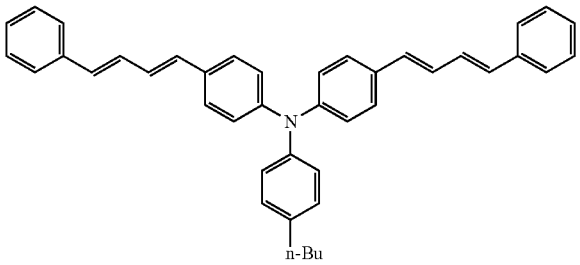
(CTM-2)
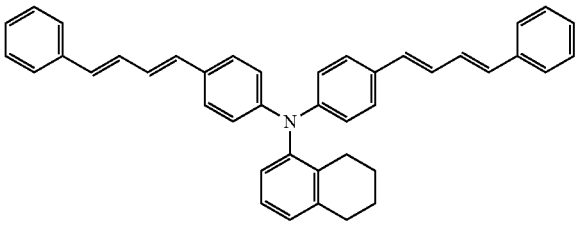

-continued
(CTM-3)
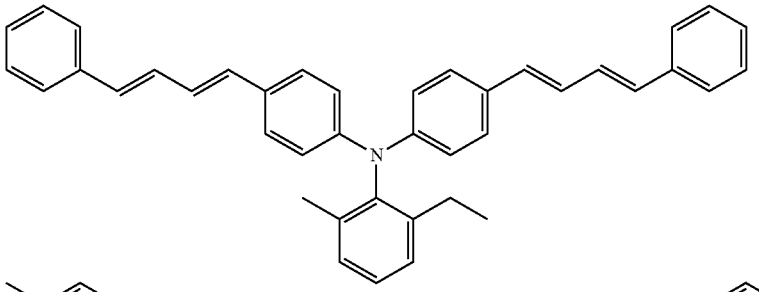
(CTM-4)
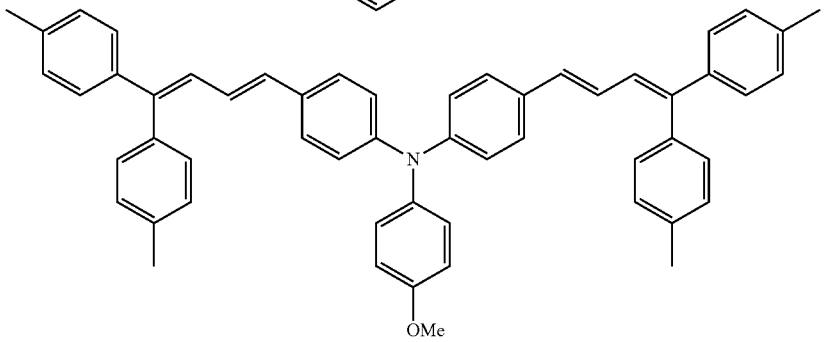
(CTM-5)
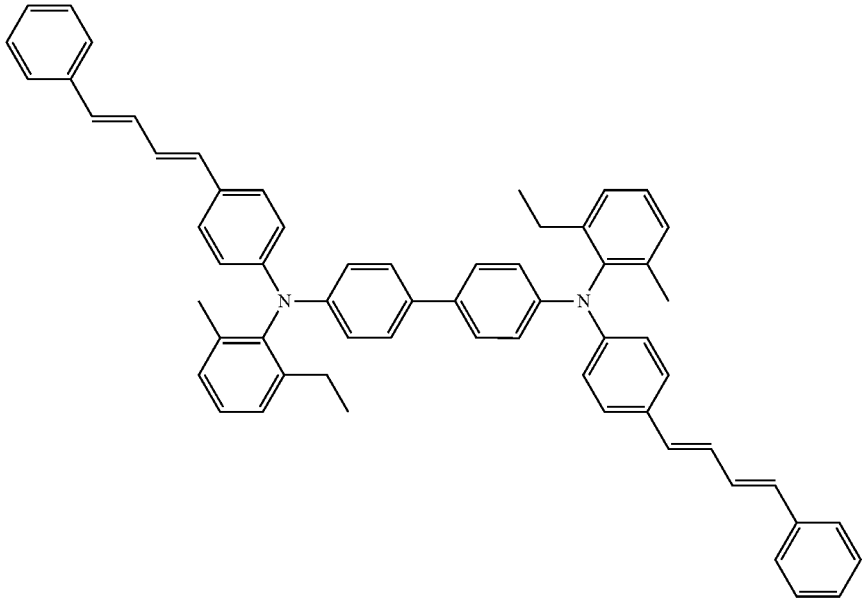
(CTM-6)
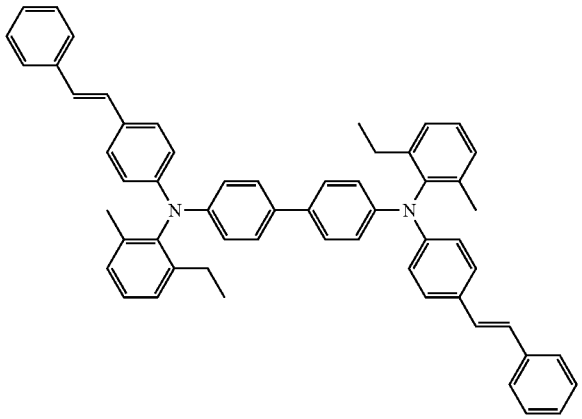
(CTM-7)
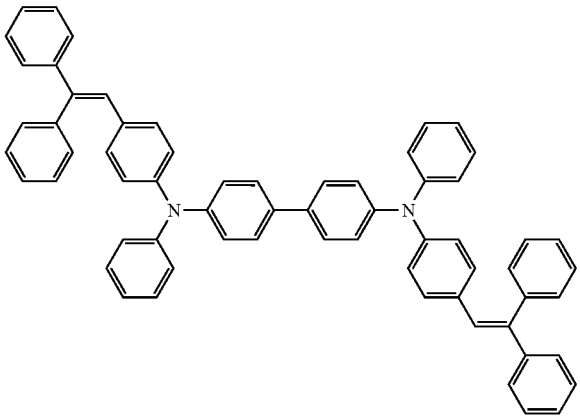

-continued (CTM-8)

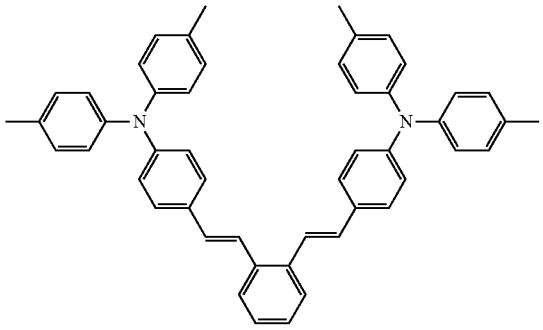

(CTM-9)

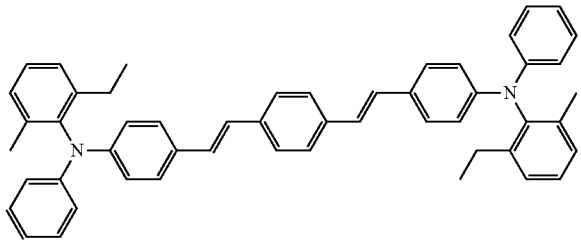

Example 1

Underlayer

A mixture was prepared by mixing 2 parts by mass of titanium oxide (test sample SMT-A produced by Tayca Corporation, number average primary particle size 10 nm), 1 part by mass of a four-component copolymer polyamide resin of polyamide 6, polyamide 12, polyamide 66, and polyamide 610 (Amilan CM8000 produced by Toray Industries, Inc.), 10 parts by mass of methanol, 1 part by mass of butanol, and 1 part by mass of toluene. An application liquid for underlayer formation was prepared by dispersing the mixture for 5 minutes using a bead mill. The application liquid for underlayer formation was then filtered using a 5 μm filter. The filtered application liquid for underlayer formation was applied onto a conductive substrate—a drum shaped support (diameter 30 mm, length 246 mm) made from aluminum—by dip coating, thereby forming an applied film on the conductive substrate. The applied film was heat treated for 30 minutes at 130° C. to form an underlayer having a film thickness of 2 μm. Note that the titanium oxide was prepared by performing surface treatment with alumina and silica, and subsequently performing surface treatment with methyl hydrogen polysiloxane during wet dispersion.

(Charge Generating Layer)

A mixture was prepared by mixing 1.5 parts by mass of titanyl phthalocyanine as a charge generating material, 1 part by mass of polyvinyl acetal resin (S-LEC BX-5 produced by Sekisui Chemical Co., Ltd.) as a charge generating layer binder resin, and 40 parts by mass of propylene glycol monomethyl ether and 40 parts by mass of tetrahydrofuran as a dispersion medium. An application liquid for charge generating layer formation was prepared by dispersing the mixture for 2 hours using a bead mill. The application liquid for charge generating layer formation was then filtered using a 3 μm filter. The filtered application liquid for charge generating layer formation was applied onto the underlayer by dip coating, thereby forming an applied film on the underlayer. The applied film was dried for 5 minutes at 50° C. to form a charge generating layer having a film thickness of 0.3 μm. Note that the titanyl phthalocyanine exhibited a major peak at a Bragg angle 2θ of 27.2° with respect to characteristic X-rays of CuKα (wavelength of 1.541 Å).

(Charge Transport Layer)

An application liquid for charge transport layer formation was prepared by mixing 50 parts by mass of the compound represented by Formula (CTM-1) as a hole transport material (HTM), 2 parts by mass of an antioxidant (IRGANOX (registered Japanese trademark) 1010 hindered phenolic antioxidant produced by BASF Japan Ltd.) as an additive, 0.3 parts by mass of the phthalocyanine pigment (pigment maximum absorption wavelength 823 nm) represented by Formula (Pigment-1), 0.2 parts by mass of dimethyl silicone oil (KF-96-50CS produced by Shin-Etsu Chemical Co., Ltd.) as a leveling agent, 100 parts by mass of bisphenol polycarbonate resin (Lupilon PCZ500 produced by Mitsubishi Gas Chemical Company, Inc., viscosity average molecular weight 50,500) as a charge transport layer binder resin, and 350 parts by mass of tetrahydrofuran and 350 parts by mass of toluene as a solvent. The application liquid for charge generating layer formation was then filtered using a 3 μm filter. The filtered application liquid for charge transport layer formation was applied onto the charge generating layer, thereby forming an applied film on the charge generating layer. The applied film was dried for 40 minutes at 120° C. to form a charge transport layer having a film thickness of 30 μm. Through the above process, a multi-layer photosensitive member was prepared in which the underlayer, the charge generating layer, and the charge transport layer were formed in stated order on the conductive substrate. Another multi-layer photosensitive member was prepared in the same way as described above, but the amount of the application liquid for charge transport layer formation that was applied onto the charge generating layer during formation of the charge transport layer was adjusted in order that a charge transport layer having a film thickness of 15 μm was formed.

Examples 2 to 7

Multi-layer photosensitive members that were each formed by layering of an underlayer, a charge generating layer, and a charge transport layer on a conductive substrate in stated order were prepared according to the same method as in Example 1, but phthalocyanine pigments represented by Formulae (Pigment-2) to (Pigment-7) (referred to below simply as Pigment-2 to Pigment-7) were used instead of using the phthalocyanine pigment represented by Formula (Pigment-1).

Examples 8 to 15

Multi-layer photosensitive members that were each formed by layering of an underlayer, a charge generating layer, and a charge transport layer on a conductive substrate in stated order were prepared according to the same method as in Example 2, but compounds represented by Formulae (CTM-2) to (CTM-9) (referred to below simply as CTM-2 to CTM-9) were used as the hole transport material instead of the compound represented by Formula (CTM-1).

Examples 16 and 17

Multi-layer photosensitive members that were each formed by layering of an underlayer, a charge generating layer, and a charge transport layer on a conductive substrate in stated order were prepared according to the same method as in Example 2, but the additive amount of the phthalocyanine pigment represented by Formula (Pigment-2) was as indicated in Table 1 instead of being 0.3 parts by mass.

Comparative Example 1

A multi-layer photosensitive member that was formed by layering of an underlayer, a charge generating layer, and a charge transport layer on a conductive substrate in stated order was prepared according to the same method as in Example 1, but the phthalocyanine pigment represented by Formula (Pigment-1) was not added.

TABLE 1

| | Pigment | Pigment maximum absorption wavelength | Pigment additive amount (parts by mass) | HTM |
|---|---|---|---|---|
| Example 1 | Pigment-1 | 823 nm | 0.3 parts | CTM-1 |
| Example 2 | Pigment-2 | 819 nm | 0.3 parts | CTM-1 |
| Example 3 | Pigment-3 | 809 nm | 0.3 parts | CTM-1 |
| Example 4 | Pigment-4 | 815 nm | 0.3 parts | CTM-1 |
| Example 5 | Pigment-5 | 819 nm | 0.3 parts | CTM-1 |
| Example 6 | Pigment-6 | 805 nm | 0.3 parts | CTM-1 |
| Example 7 | Pigment-7 | 857 nm | 0.3 parts | CTM-1 |
| Example 8 | Pigment-2 | 819 nm | 0.3 parts | CTM-2 |
| Example 9 | Pigment-2 | 819 nm | 0.3 parts | CTM-3 |
| Example 10 | Pigment-2 | 819 nm | 0.3 parts | CTM-4 |
| Example 11 | Pigment-2 | 819 nm | 0.3 parts | CTM-5 |
| Example 12 | Pigment-2 | 819 nm | 0.3 parts | CTM-6 |
| Example 13 | Pigment-2 | 819 nm | 0.3 parts | CTM-7 |
| Example 14 | Pigment-2 | 819 nm | 0.3 parts | CTM-8 |
| Example 15 | Pigment-2 | 819 nm | 0.3 parts | CTM-9 |
| Example 16 | Pigment-2 | 819 nm | 0.15 parts | CTM-1 |
| Example 17 | Pigment-2 | 819 nm | 0.6 parts | CTM-1 |
| Comparative Example 1 | — | — | — | CTM-1 |
| Comparative Example 2 | Pigment 8 | 610 nm | 0.4 parts | CTM-1 |

TABLE 2

| | Electrical properties for 30 μm film thickness | | | | Electrical properties for 15 μm film thickness | | |
|---|---|---|---|---|---|---|---|
| | $V_0$ [V] | E½ [μJ/cm²] | $V_L$ [V] | Charge transport layer transmittance | E1/2 [μJ/cm²] | $V_L$ [V] | E½ ratio of 15 μm and 30 μm film thicknesses |
| Example 1 | −702 | 0.23 | −85 | 35% | 0.27 | −80 | 1.18 |
| Example 2 | −698 | 0.24 | −85 | 34% | 0.26 | −82 | 1.08 |
| Example 3 | −690 | 0.23 | −86 | 34% | 0.26 | −82 | 1.13 |
| Example 4 | −711 | 0.21 | −84 | 39% | 0.26 | −75 | 1.25 |
| Example 5 | −685 | 0.23 | −87 | 35% | 0.27 | −77 | 1.18 |
| Example 6 | −701 | 0.24 | −85 | 34% | 0.27 | −74 | 1.17 |
| Example 7 | −720 | 0.13 | −84 | 60% | 0.21 | −76 | 1.55 |
| Example 8 | −704 | 0.24 | −88 | 33% | 0.28 | −74 | 1.15 |
| Example 9 | −700 | 0.24 | −85 | 34% | 0.27 | −75 | 1.17 |
| Example 10 | −705 | 0.23 | −79 | 35% | 0.27 | −70 | 1.18 |
| Example 11 | −699 | 0.22 | −79 | 37% | 0.26 | −68 | 1.22 |
| Example 12 | −685 | 0.22 | −85 | 36% | 0.27 | −75 | 1.20 |
| Example 13 | −702 | 0.24 | −86 | 34% | 0.27 | −76 | 1.17 |
| Example 14 | −689 | 0.23 | −92 | 35% | 0.27 | −83 | 1.18 |
| Example 15 | −706 | 0.23 | −94 | 35% | 0.27 | −85 | 1.18 |
| Example 16 | −710 | 0.14 | −84 | 57% | 0.21 | −73 | 1.51 |
| Example 17 | −718 | 0.57 | −121 | 14% | 0.43 | −110 | 0.75 |
| Comparative Example 1 | −700 | 0.08 | −78 | 98% | 0.16 | −69 | 1.98 |
| Comparative Example 2 | −1034 | — | −800 | 90% | — | −800 | — |

Comparative Example 2

A multi-layer photosensitive member that was formed by layering of an underlayer, a charge generating layer, and a charge transport layer on a conductive substrate in stated order was prepared according to the same method as in Example 1, but 0.4 parts by mass of copper(II) phthalocyanine-tetrasulfonic acid tetrasodium salt (referred to below simply as Pigment-8, pigment maximum absorption wavelength 610 nm) was added instead of 0.3 parts by mass of the phthalocyanine pigment represented by Formula (Pigment-1).

<<Evaluation>>

Evaluation of the photosensitive members in the Examples and Comparative Examples was performed according to the standards described below. Evaluation results are shown in Table 2.

(Electrical Properties Evaluation)

<Evaluation of Photosensitive Member Charging Ability>

The surface potential of each photosensitive member prepared as described above was measured using an electrical properties tester (product of GENTEC). The surface of the photosensitive member was charged under conditions of a photosensitive drum rotation speed of 31 rpm and an inflow current of −6 μmA. The surface potential of the photosensitive drum was measured and the measured surface potential was defined as a charging potential ($V_0$).

<Evaluation of Photosensitive Member Sensitivity>

The surface potential of each photosensitive member prepared as described above was measured using the electrical properties tester (product of GENTEC). The surface of the photosensitive member was charged to a surface potential of −800 V. The charged surface of the photosensitive member was exposed to light having a wavelength of 780 nm with a light exposure quantity of 1.0 μJ/cm$^2$. The surface potential of the photosensitive member was measured 80 ms after exposure to the light and the measured surface potential was defined as a sensitivity potential ($V_L$). Also, the surface of the photosensitive member was charged to a surface potential of −800 V. The surface of the photosensitive member was exposed to light having a wavelength of 780 nm. More specifically, the surface of the photosensitive member was exposed to the light such that the surface potential of the photosensitive member 80 ms after exposure was −400 V. The light exposure quantity was calculated for the above exposure and the calculated light exposure quantity was defined as E1/2.

(Transmittance Measurement Method)

The application liquid for charge transport layer formation used in each of the Examples and Comparative Examples was applied onto non-reflective glass using an applicator and dried thereon to form an applied film having a thickness of 30 μm. Transmittance of the applied film with respect to light having a wavelength of 780 nm was obtained by measuring a transmittance of the non-reflective glass itself and a transmittance of the non-reflective glass with the applied film thereon using a spectrometer (U-3000 produced by Hitachi High-Technologies Corporation) and by calculating a difference between the measured transmittances.

Note that the charge transport layer having the film thickness of 15 μm was evaluated in the same way as the charge transport layer having the thickness of 30 μm by measuring transmittance, and evaluating E1/2 and $V_L$.

As show by the results in Table 2, due to the charge transport layer containing a phthalocyanine pigment represented by any of Formulae (Pigment-1) to (Pigment-7), the Examples 1-17 achieved excellent electrical properties compared to Comparative Example 1 in which no pigment was added and Comparative Example 2 in which copper(II) phthalocyanine-tetrasulfonic acid tetrasodium salt was added as a pigment.

What is claimed is:

1. An electrophotographic photosensitive member comprising:

a conductive substrate; and a photosensitive layer located either directly or indirectly on the conductive substrate, wherein the photosensitive layer contains at least a charge generating material, a charge transport material, and a binder resin, the photosensitive layer includes a charge generating layer and a charge transport layer located on the charge generating layer, the charge transport layer contains a pigment that is absorptive with respect to a wavelength of exposed light, and the pigment is a metal phthalocyanine pigment represented by General Formula (I) or a metal-free phthalocyanine pigment represented by General Formula (II), (I)

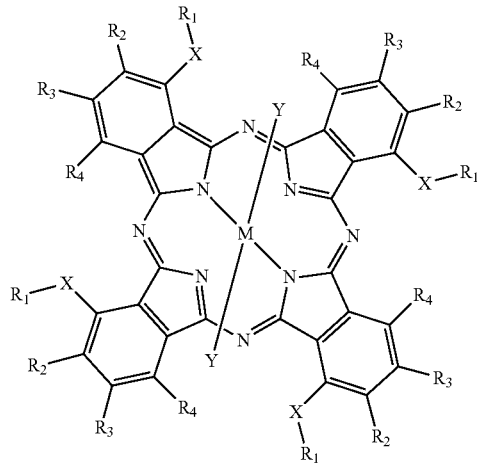

(II)

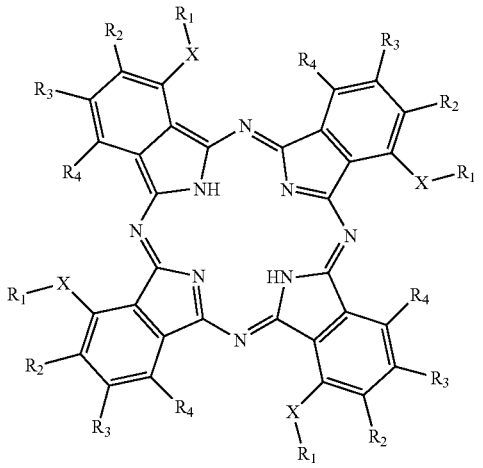

where, in the General Formulae (I) and (II), X represents a sulfur atom or an oxygen atom, $R_1$ represents an optionally substituted aryl group or an alkyl group, $R_2$ to $R_4$ each represent, independently of one another, a hydrogen atom, an optionally substituted alkyl group, an aryl group, an alkoxy group, an optionally substituted phenoxy group, an alkylthio group, an optionally substituted phenylthio group, or a dialkylamino group, and in the General Formula (I), M represents a metal atom, and Y represents non-substitution or represents an optionally substituted alkyl group, an alkoxy group, an aryloxy group, a halogen atom, an oxygen atom, or a hydroxyl group.

2. The electrophotographic photosensitive member according to claim 1, wherein the charge transport layer has a transmittance of at least more than 5% and less than 80% with respect to the wavelength of exposed light.

3. The electrophotographic photosensitive member according to claim 1, wherein the charge generating material contains titanyl phthalocyanine that exhibits a major peak at a Bragg angle 2θ of 27.2° with respect to characteristic X-rays of CuKα having a wavelength of 1.541 Å.

4. The electrophotographic photosensitive member according to claim 1, wherein the charge transport material is a compound represented by General Formula (III), General Formula (W), or General Formula (V), (III)

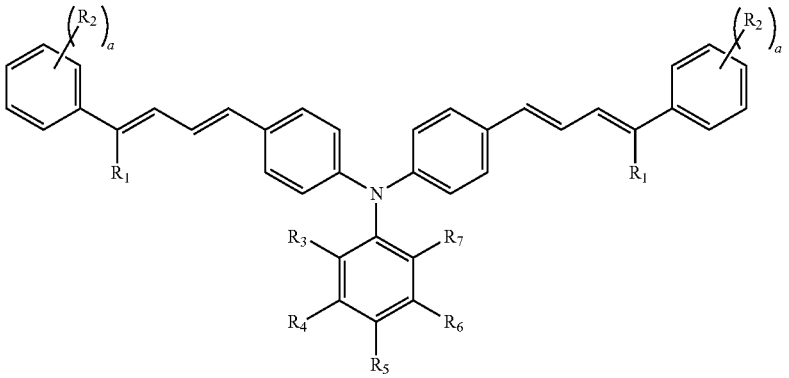

where, in the General Formula (III), $R_1$ and $R_3$ to $R_7$ each represent, independently of one another, a hydrogen atom, an alkyl group having a carbon number of at least 1 and no greater than 8, an optionally substituted phenyl group, or an alkoxy group, $R_2$ represents an alkyl group having a carbon number of at least 1 and no greater than 8, an optionally substituted phenyl group, or an alkoxy group, members of $R_3$ to $R_7$ that are bonded to adjacent carbon atoms in a benzene ring are optionally bonded to one another to form a ring, and a represents an integer of at least 0 and no greater than 5, (IV)

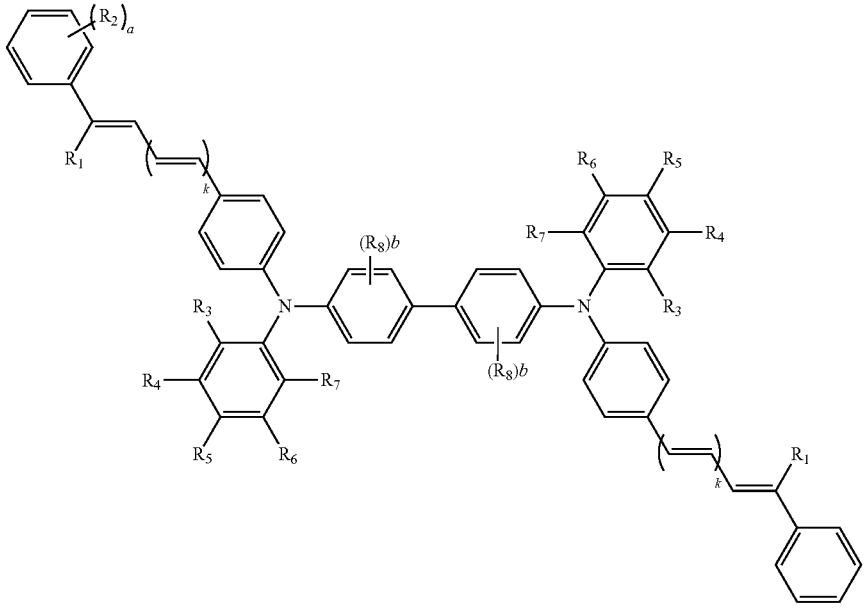

in the General Formula (IV), $R_1$ and $R_3$ to $R_7$ each represent, independently of one another, a hydrogen atom, an alkyl group having a carbon number of at least 1 and no greater than 8, or a phenyl group, $R_2$ and $R_8$ each represent, independently of one another, an alkyl group having a carbon number of at least 1 and no greater than 8 or a phenyl group, a represents an integer of at least 0 and no greater than 5, b represents an integer of at least 0 and no greater than 4, and k represents 0 or 1, and (V)
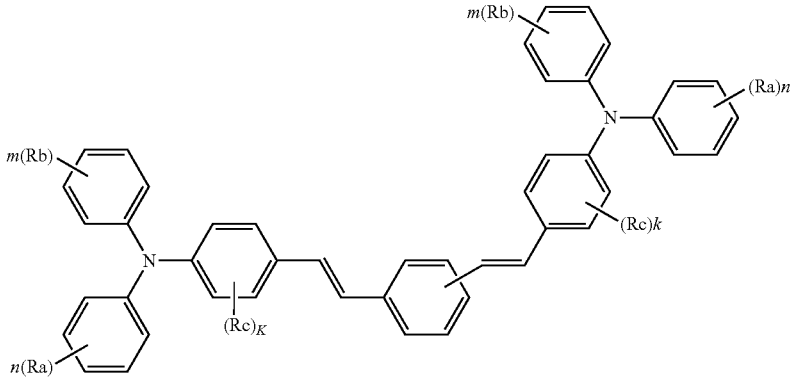
in the General Formula (V), Ra, Rb, and Rc each represent, independently of one another, an alkyl group having a carbon number of at least 1 and no greater than 8, a phenyl group, or an alkoxy group, k represents an integer of at least 0 and no greater than 4, and m and n each represent, independently of one another, an integer of at least 0 and no greater than 5.
* * * * *